US005237715A

United States Patent [19]

Bane, III

[11] Patent Number: 5,237,715

[45] Date of Patent: Aug. 24, 1993

[54] BOATSWAIN MATE FIVE IN ONE TOOL

[76] Inventor: Harvey M. Bane, III, 2204 W. 14th St., Panama City, Fla. 32401

[21] Appl. No.: 948,652

[22] Filed: Sep. 23, 1992

[51] Int. Cl.[5] ..... B25F 1/00

[52] U.S. Cl. ..... 7/139; 7/143; 7/165; 7/170

[58] Field of Search ..... 7/143, 165, 138, 139, 7/170; 81/129, 166, 167

[56] References Cited

U.S. PATENT DOCUMENTS

D. 156,732 1/1950 Hoeflicker ..... 7/143
2,528,128 10/1950 Forster ..... 7/143
4,234,987 11/1980 Charette ..... 7/143

*Primary Examiner*—Roscoe V. Parker

*Attorney, Agent, or Firm*—Richard L. Miller

[57] ABSTRACT

A boatswains mate five in one tool to accomplish various tasks on board a ship is provided, which consists of an adjustable wrench portion for loosening and tightening a nut. A hammer portion extends from one side of the adjustable wrench portion, in which the hammer portion is for driving a nail into a work piece. A marline spike portion extends from a bottom end of the adjustable wrench portion, in which the marline spike portion is for torquing an eye bolt in a work piece and separating the strands of a rope knot. A drift punch for performing an alignment procedure through two holes in two work pieces. A screwdriver portion is located on a distal end of the marline spike portion, in which the screwdriver portion is for driving a screw into a work piece.

3 Claims, 1 Drawing Sheet

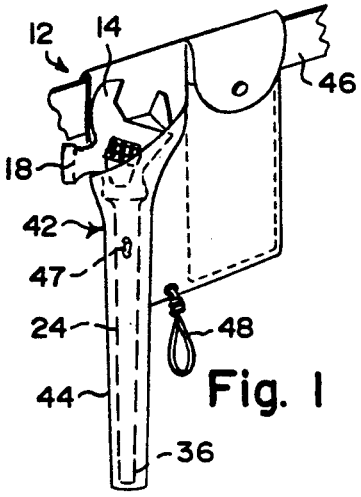
Fig. 1
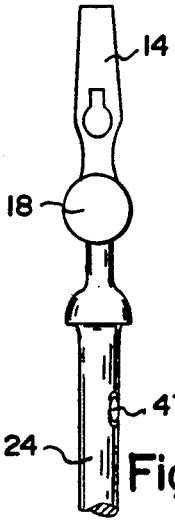
Fig. 3
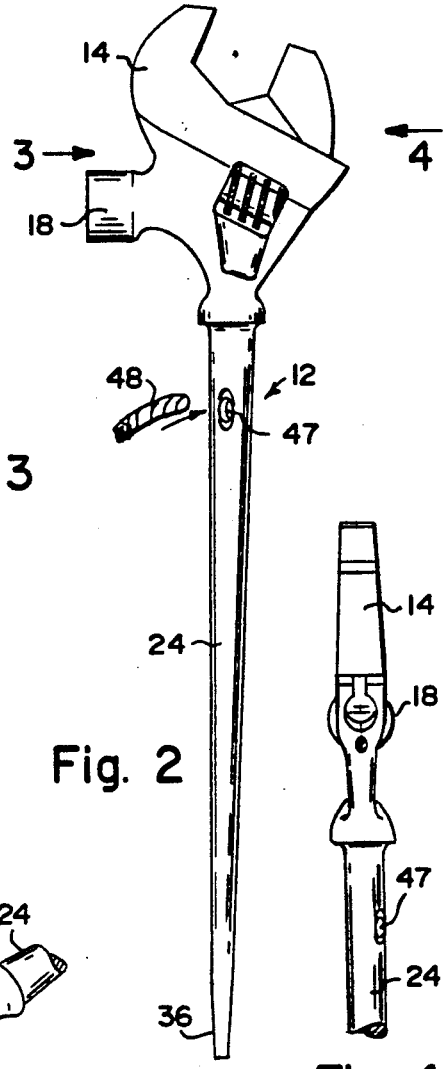
Fig. 2
Fig. 4
Fig. 5
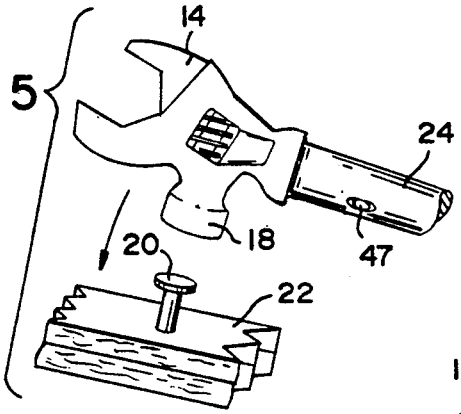
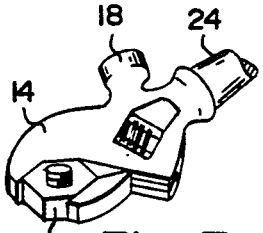
Fig. 7
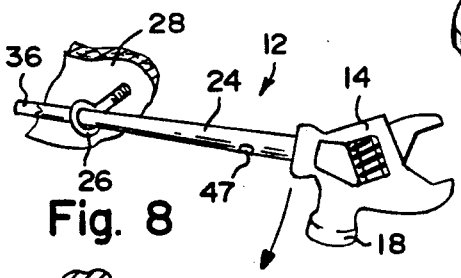
Fig. 8
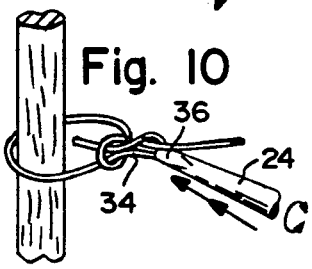
Fig. 10
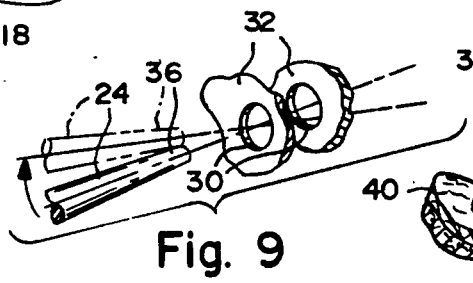
Fig. 9
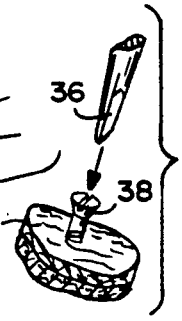
Fig. 6

BOATSWAIN MATE FIVE IN ONE TOOL

BACKGROUND OF THE INVENTION

The instant invention relates generally to hand-held implements and more specifically it relates to a boatswains mate five in one tool.

Numerous hand-held implements have been provided in the prior art that are adapted to perform accomplished work procedures, such as hammers, saws, drills and the like. For example, U.S. Pat. Nos. 4,624,323 to Burrola; 4,700,420 to Belanger and Des. 298,407 to Vowell Jr. all are illustrative of such prior art. While these units may be suitable for the particular purpose to which they address, they would not be as suitable for the purpose of the present invention as hereafter described.

SUMMARY OF THE INVENTION

A primary object of the present invention is to provide a boatswains mate five in one tool that will overcome the shortcomings of the prior art devices.

Another object is to provide a boatswains mate five in one tool that can be used to substitute for a wrench, hammer, marline spike, screwdriver and drift punch, so that the boatswains mate can carry one tool instead of five different tools to accomplish various tasks on board a ship.

An additional object is to provide a boatswains mate five in one tool that can be stowed in a tool pouch worn on a belt to be readily accessible therefrom.

A further object is to provide a boatswains mate in one tool that is simple and easy to use.

A still further object is to provide a boatswains mate five in one tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the instant invention being stowed in a tool pouch;

FIG. 2 is a side elevational view of the instant invention per se;

FIG. 3 is a view with parts broken away taken in the direction of arrow 3 in FIG. 2;

FIG. 4 is a view with parts broken away taken in the direction of arrow 4 in FIG. 2;

FIG. 5 illustrates the instant invention being used to substitute for a hammer;

FIG. 6 illustrates the instant invention being used to substitute for a screwdriver;

FIG. 7 illustrates the instant invention being used to substitute as an adjustable wrench;

FIG. 8 illustrates the instant invention being substituted for a marline spike for torquing an eye bolt;

FIG. 9 illustrates the instant invention being substituted for a drift punch during an alignment procedure; and FIG. 10 illustrates the instant invention being substituted for a marline spike when separating the strands of a rope knot.

DETAILED DESCRIPTION OF THE PREFERRED EMBODIMENTS

Turning now descriptively to the drawings, in which similar reference characters denote similar elements throughout the several views, the Figures illustrate a boatswains mate five in one tool 12 to accomplish various tasks on board a ship, which consists of an adjustable wrench portion 14 for loosening and tightening a nut 16. A hammer head portion 18 extends from one side of the adjustable wrench portion 14, in which the hammer portion 18 has an appropriate face that may be typically used for driving a nail 20 into a work piece 22. A marline spike portion 24 extends from a bottom end of the adjustable wrench portion 14. The marline spike portion 24 is typically for torquing an eye bolt 26 in a work piece 28, and separating the strands of a rope knot 34. A screwdriver portion 36 is located on a distal end of the marline spike portion 24, in which the screwdriver portion 36 is typically used for driving a screw 38 into a work piece 40, may have a keystone tip as illustrated in FIG. 6, or numerous other types such as a phillips head tip not illustrated. A drift punch for preforming an alignment procedure through two holes 30 in two work pieces 32.

The adjustable wrench portion 14, the hammer portion 18, the marline spike portion 24 and the screwdriver portion 36 are integral and fabricated preferably out of a non-corrosive metal material, so that the tool 12 can be used near salt water.

The boatswains mate five in one tool 12 may further includes a tool pouch 42 having a sheath 44. The tool pouch 42 can be worn on a belt 46 of the boatswains mate with the tool 12 stowed in the sheath 44 to be readily accessible therefrom. The marline spike portion 24 has a transverse aperture 47 therethrough to receive a lanyard 48 for securing the tool 12 to the tool pouch 42. When the boatswains mate in one instance is working aloft and in another instance is working over the side of the ship, the secured tool 12 cannot be dropped onto a bystander and into the water.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A boatswain mate five in one tool to accomplish various tasks on board a ship, which comprises:

a) an adjustable wrench portion for loosening and tightening nuts having a fixed jaw portion and a removable jaw portion mounted for sliding adjustment relation thereto in a through-bore extending transversely through the fixed jaw;

b) a hammer portion integrally formed with an extending from one side of said fixed jaw portion with the through-bore extending obliquely out of alignment with the hammer portion in which said hammer portion is for driving a nails and similar articles into a work piece;

c) a marline spike portion integrally formed with and extending from a bottom end of said adjustable wrench portion, in which said marline spike portion is for torquing an eye bolt in a work piece, and separating the strands of a rope knot;

d) a screwdriver portion integrally formed with a distal end of said marline spike portion, in which said screwdriver portion is for driving a screw into a work piece; and e) a drift punch for performing an alignment procedure through two holes in two work pieces.

2. A boatswains mate five in one tool as recited in claim 1, further including a tool punch having a sheath, so that said tool pouch can be worn on a belt of the boatswains mate with said tool stowed in said sheath to be readily accessible therefrom.

3. A boatswains mate five in one tool as recited in claim 2, further including said marline spike portion having a transverse aperture therethrough to receive a lanyard for securing said tool to said tool pouch, so that when the boatswains mate in one instance is working aloft and in another instance is working over the side of the ship, said secured tool cannot be dropped onto a bystander and into the water.

* * * * *